US005899037A

United States Patent [19]

Josey

[11] Patent Number: 5,899,037

[45] Date of Patent: May 4, 1999

[54] COMPOSITE WALL STRUCTURE

[76] Inventor: Gary L. Josey, P.O. Box 7216, Wilmington, N.C. 28406

[21] Appl. No.: 08/902,168

[22] Filed: Jul. 29, 1997

[51] Int. Cl.[6] ..... E04B 1/00

[52] U.S. Cl. ..... 52/267; 52/269; 52/787.11; 52/793.1; 52/794.1; 428/118

[58] Field of Search ..... 52/265, 267, 269, 52/787.11, 793.1, 794.1, 586.1; 428/118

[56] References Cited

U.S. PATENT DOCUMENTS

| | | | |
|---|---|---|---|
| 2,849,758 | 9/1958 | Plumley | 52/793.1 X |
| 3,315,424 | 4/1967 | Smith | 52/269 |
| 3,529,389 | 9/1970 | Wilkins . | |
| 4,014,143 | 3/1977 | Purcell | 52/90 |
| 4,021,983 | 5/1977 | Kirk, Jr. | 52/793.1 X |
| 4,084,366 | 4/1978 | Saylor et al. . | |
| 4,606,959 | 8/1986 | Hillinger . | |
| 4,749,601 | 6/1988 | Hillinger | 52/793.1 X |
| 4,796,397 | 1/1989 | Capaul . | |
| 4,852,316 | 8/1989 | Webb . | |
| 4,937,125 | 6/1990 | Sanmartin et al. | 52/794.1 X |
| 5,070,670 | 12/1991 | Alderson . | |
| 5,106,668 | 4/1992 | Turner et al. . | |
| 5,279,089 | 1/1994 | Gulur | 52/794.1 X |
| 5,287,675 | 2/1994 | McGee | 52/265 X |
| 5,328,744 | 7/1994 | Kaufmann et al. | 52/793.1 X |
| 5,377,470 | 1/1995 | Hebinck | 52/405.1 |
| 5,390,468 | 2/1995 | Probst . | |
| 5,564,243 | 10/1996 | Kroll et al. | 52/269 X |
| 5,628,158 | 5/1997 | Porter | 52/794.1 X |

*Primary Examiner*—Christopher Kent
*Assistant Examiner*—Timothy B. Kang
*Attorney, Agent, or Firm*—Rhodes, Coats & Bennett, L.L.P.

[57] ABSTRACT

A wall structure for a manufactured building is constructed of a plurality of adjacent composite panels, each panel having a honeycomb core and exterior and interior steel skins; vertical tubular steel studs having openings for carrying electrical wiring are secured to the exterior skins of the panels with double-sided adhesive tape. Interior surfacing material is attached to the interior skins; exterior surfacing material attached to the studs; insulation material is positioned between the studs; and splines extend between adjacent panels to improve rigidity. Bottom and top attachment plates attach the wall structure to the rest of the building.

18 Claims, 3 Drawing Sheets

COMPOSITE WALL STRUCTURE

BACKGROUND OF THE INVENTION (1) Field of the Invention

The present invention relates generally to improvements in the construction of manufactured buildings, e.g., modular or mobile homes. The invention relates in particular to wall structures for such buildings, and to composite structural panels and other components used as a part of these wall structures.

(2) Description of the Prior Art

Modular buildings, also known as manufactured buildings, are constructed at least in part at a remote site. The entire building can be constructed at the production facility, and then moved to a permanent location where the building is positioned on a foundation. In other instances, components of the building, e.g. wall, floor or ceiling components, are manufactured at the remote site, and assembled at the final destination. This type of construction is widely used to construct residential buildings, commonly known as a mobile homes, or manufactured housing, as well as in other residential and commercial structures.

Manufactured building are comprised of a supporting floor structure adapted to be positioned on a foundation, or on a wheeled support. This floor structure supports walls and other components of a building, which may be constructed of prefabricated panels. Insulation, an outer covering, and utilities, are then added to complete the building structure.

The wall structure conventionally used prior to the present invention is constructed with a framework of vertical, spaced 2×4 southern white pine studs or upright members, with horizontal cross bracing members. The framework members can also be of metal, e.g., square tubular steel.

A facing material, e.g., sheet rock, is used to cover the interior surfaces of the framework, while a sheathing material, such as plywood, is used to cover the exterior of the framework. If the wall is to be used on the exterior of the building, an insulation barrier, such as a fiberglass batting is normally positioned between the studs within the cavity defined by the interior and exterior surfacing materials.

This prior art construction suffers from several potentially hazardous deficiencies. Of major concern is the fact that various electrical outlets within the building are connected to an external source of electricity by wiring that is strung within the wall, through openings or holes in the studs. The presence of this wiring within the wall cavity adjacent flammable interior wall components can become a fire hazard in the event of defects in insulation, or exposure of the wiring to moisture.

In addition, connecting points between components of a conventional manufactured housing wall can become loosened by flexing during transport of the building, or during severe adverse weather conditions, resulting in weakening or even collapse of the wall.

Thus, there is a need for an improved wall structure for manufactured buildings that exhibits reduced flexing, and has improved resistance to fire, particularly electrical fires.

SUMMARY OF THE INVENTION

The present invention is directed to a composite wall structure, and to the construction of composite wall structures having reduced flexing and improved fire resistance.

The wall system of the present invention is comprised of a plurality of preformed, upright composite wall panels with inner and outer faces. The panels are assembled with abutting adjacent edges to form the desired wall. Splines are used to secure the panels in a rigid, edge-to-edge relationship. The lower edges of the wall panels are mounted on an attachment plate to secure the panels to the floor of the structure. A top plate or cap is positioned on the upper edges of the panels to facilitate attachment of the wall to the ceiling or roof. A plurality of upright, spaced, stud members are attached to the outer faces of the composite panels.

The wall system may also include exterior surfacing members attached to the outer faces of the stud members; insulation sections inserted between the stud members, and between the outer faces of the composite panels and the inner surface of the exterior surfacing members; and an interior surfacing member attached to the inner faces of the composite panels.

The composite panels are similar in construction to the floor panels described in co-pending and commonly assigned U.S. patent application Ser. No. 08/704,230, filed Aug. 27, 1996. The wall structure of the present invention can be used in combination with the floor structure described therein to construct a manufactured building.

Each composite wall panel is comprised of a honeycomb core or insert, a frame or closeout surrounding the periphery of the honeycomb core, and skins across the opposed faces of the honeycomb core. The honeycomb core is generally of a rectangular configuration, although some sections may be of other shapes, e.g., triangular, if needed to form sections of a wall of a particular design.

While the holes in the honeycomb core will ordinarily be of a hexagonal cross-section, it should be understood that the term "honeycomb," as used herein, is intended to encompass cores formed with holes of other cross-sectional shapes, e.g., triangular, rectangular, or parabolic. Hexagonal holes will have a cross-sectional length of from about three-eighths to about one inch, and a cross-sectional width of from about one-fourth to about one-half inch. Preferably, the hexagonal holes will have a length of about one-half inch and a width of about three-eighths inch. Other hole shapes will be of approximately an equivalent cross-sectional area.

The honeycomb core may be formed of various materials, e.g., steel, aluminum, plastic or paper. For reasons of cost and weight, the honeycomb core is desirably formed of strips of kraft paper with discrete areas joined to adjacent strips to form a plurality of openings or holes when the core is expanded. The kraft paper best suited for manufacture of the core is linerboard or saturating type kraft paper derived from southern grown farm pines, processed into pulp with a long fiber grain specifically oriented for optimum strength. In order to achieve the desired strength, the kraft paper should be at least 18#, and preferably 33 to 42# paper.

Moisture resistance and strength are increased by impregnating the paper with up to about 38% by weight of a resin, normally a water or other solvent based resin, such as a low-emission, waterborne phenolic resin of the type sold by Georgia-Pacific Resins, Inc., Decatur, Georgia as item number GP 413D97.

The honeycomb insert panel or core is surrounded by a frame having an inner opening with a periphery corresponding to the outer periphery of the honeycomb core, so that the honeycomb core fits snugly into the frame opening. Normally, the frame will be rectangular, with spaced, parallel side members, having their ends joined to the ends of spaced, parallel end members. The frame members are preferably formed of wood, and even more preferably, are formed of a composite wood product. Such a product is described as "Engineered Strand Lumber" or "Parallel Stand Lumber." These composite wood products are made from long, thin strands of wood that are bonded under heat and pressure. Composite wood products are preferred because they are straighter and stronger than solid sawn lumber, and use raw materials more efficiently.

Each frame member will ordinarily have a rectangular cross-section, with a height or thickness corresponding to the thickness of the honeycomb core, and a width or horizontal dimension, of from about 1 to about 6 inches. The side members will have a length equal to the length of the honeycomb core, plus the width of the end members, and the end members will have a length equal to the width of the honeycomb core, thereby forming an interior opening corresponding to the outer dimensions of the honeycomb panel. Alternatively, the ends of the end members can extend over the ends of the side members. In this case, end members will have a length equal to the width of the honeycomb panel, plus the width of the side members, and side members will have a length equal to the length of the honeycomb core.

For most applications, the panel will be from about 8 to about 9 feet in height, from about 1 to about 4 feet in width, and from about 1 to about 6 inches in thickness. In order to standardize the product, and conform to the dimensions of other components of the structure, the panels will normally be manufactured in widths that are multiples of 1 foot.

The skins of the honeycomb core are formed of a non-flammable sheet material, such as sheet steel, and are preferably formed of fall hard steel, i.e., steel that has not been annealed. Full hard steel is essentially unbendable, and is ideally suited for the purposes of the present invention, in that flexing of the structure is largely prevented.

Preferably, each skin is rectangular, with dimensions equal to the outer dimensions of the panel framework, thereby entirely covering the surface of the panel. The thickness of the panel will normally be from about 1 to 4 inches, depending upon the structure in which the panel is used. The steel skins may be galvanized to reduce rusting, and can be acid etched to enhance adhesive bonding.

In forming the composite panel, the ends of the end and side sections of the panel frame are joined with an adhesive and/or fasteners. The honeycomb core is then inserted into the interior opening of the frame. One of the skins can be joined to a side of the frame before insertion of the honeycomb core, or both skins can be secured to the frame after the honeycomb core is in place. A preferred way to secure the skins is with an adhesive, such as a water-based, urethane adhesive, which is coated onto the faces of the honeycomb core and frame.

When the wall is assembled, adjacent or abutting edges of the wall panels may be secured to each other with an adhesive. Since there will be some expansion and contraction of the wood components of the panels, a flexible adhesive is used in this application, so that the expansion and contraction can occur without affecting the steel skins. The adhesive should have a strength in three directions of at least 80 psi. A suitable adhesive is sold under the trademark CX-80 by Chemrex Corporation, Shakopee, Minn. Alternatively, the adjacent surfaces of the panels can be joined using a double-sided industrial adhesive tape, such as an acrylic, very high bond (VHB), tape manufactured by the 3M Company, St. Paul, Minn. The adhesive or tape is used to join adjacent faces of abutting wood frames.

Rigidity of the structure is improved by inserting a spline or key between adjacent panels. For this purpose, longitudinal grooves or slots are cut or routed into faces of the frame equi-distant between the steel skins. A spline or key is then inserted into facing slots of adjacent frames. These slots then form a channel when panels are positioned with faces of adjacent panels abutting. Preferably the spline is formed of cold rolled steel having a thickness of from about 0.125 to about 0.250 inch, and a width of from about 0.75 to about 1 inch. The depth and width of each slot is preferably about one-sixteenth inch greater than the corresponding key dimensions to allow for expansion. The length of the key can be up to approximately the length of the slotted panel member., or less with the ends being covered by the end frame members.

In building construction, the lower edges of the composite panels are positioned on a horizontal support member forming a part of the building structure. Depending upon the details of the building construction, the horizontal support member may be the building floor or a part of the building chassis or foundation framework. A bottom panel attachment plate may be used to secure the panels to the horizontal support member, and to align the lower edges of the panels.

The bottom attachment plate, which may be formed of multiple plate segments positioned end-to-end, is comprised of a horizontal bottom plate to attach the support plate to the horizontal support member, and a vertical back plate to attach the support plate to the panel members. A vertical front plate can also be included to form, in cooperation with the bottom and back plates, a channel into which the panels can be positioned.

Similarly, a top panel attachment plate, which may also be formed of multiple plate segments positioned end-to-end, is used to secure the top of the panels to the ceiling or roof of the building. The top attachment plate is comprised of a horizontal top plate to attach the support plate to the ceiling or roof, and a vertical back plate to attach the support plate to the panel members.

In order to secure outer surfacing material or sheathing to the wall exterior, the wall structure also includes a plurality of upright stud members that are secured to the exterior faces of the panels, normally at a spacing of from 16 inches to 24 inches on center. These studs may be formed of wood or other structural material, but are preferably formed of square or channel-shaped metal tubing. Each stud includes channels or holes extending through the stud from one side to the other to receive electrical wiring and other utility lines or conduits, such as plumbing lines.

The studs can be secured to the outer face of the panels by a variety of means, depending upon the nature of the materials. Preferably, however, the studs include a strip of double-sided adhesive tape of the type previously described along one edge. In order to attach the stud, the protective sheet is removed from the tape, and the stud is pressed in the desired location against the panel wall.

Normally, the exterior of the wall will be covered with an exterior surfacing material for purposes of protection and decoration. The nature of the exterior surfacing member can vary considerably depending upon the appearance desired, the conditions to which the building will be subjected, and cost factors. Examples of exterior surfacing materials include vinyl, wood or brick siding. The exterior surfacing material can be secured to the outer faces of the studs by a variety of means, depending upon the nature of the materials. Preferably, however, the exterior surfacing material is attached to the outer faces of the studs with strips of double-sided adhesive tape.

The interior wall cavities formed between adjacent studs, the front face of the panel, and the inner face of the exterior surfacing material, can be filled with an insulation material such as foam or fiberglass insulation. Preferably, the insulation is in the form of preformed sheets or batting having a width equal to the distance between the studs, so that the insulation can be positioned between the studs after the studs are secured to the wall panels, and before the exterior surfacing material is applied.

An interior surfacing material can also be applied to the inner face of the wall panels. Examples of interior surfacing materials include wood veneer, dry wall, wallpaper, etc. The interior surfacing material can be secured to the exposed inner face of the composite panels by a variety of means, depending upon the nature of the materials. Preferably, however, the interior surfacing material is attached to the panels with strips of double-sided adhesive tape.

Accordingly, one aspect of the present invention is to provide a wall structure for a manufactured building, the wall having an exterior side and an interior side, comprising a plurality of adjacent composite panels, each panel having a honeycomb core with opposed faces and a continuous outer periphery, a frame surrounding the periphery of the honeycomb core, and non-flammable exterior and interior skins secured across the opposed faces of the panel; and studs having opening for carrying electrical wiring secured to the exterior skins of the panels.

Another aspect of the present invention is to provide a wall structure for a manufactured building, the wall having an exterior side and an interior side, comprising a plurality of adjacent composite panels, each panel having a honeycomb core with opposed faces and a continuous outer periphery, a frame surrounding the periphery of the honeycomb core, and exterior and interior steel skins secured across the opposed faces of the panel; studs having openings for carrying electrical wiring secured to the exterior skins of the panels; interior surfacing material attached to the interior skins; and exterior surfacing material attached to the studs.

Still another aspect of the present invention is to provide a wall structure for a manufactured building, the wall having an exterior side and an interior side, comprising a plurality of adjacent composite panels, each panel having a paper honeycomb core with opposed faces and a continuous outer periphery, a frame surrounding the periphery of the honeycomb core, and exterior and interior steel skins secured across the opposed faces of the panel; vertical tubular steel studs having opening for carrying electrical wiring secured to the exterior skins of the panels with double-sided adhesive tape; interior surfacing material attached to the interior skins; exterior surfacing material attached to the studs; and insulation material between the studs.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
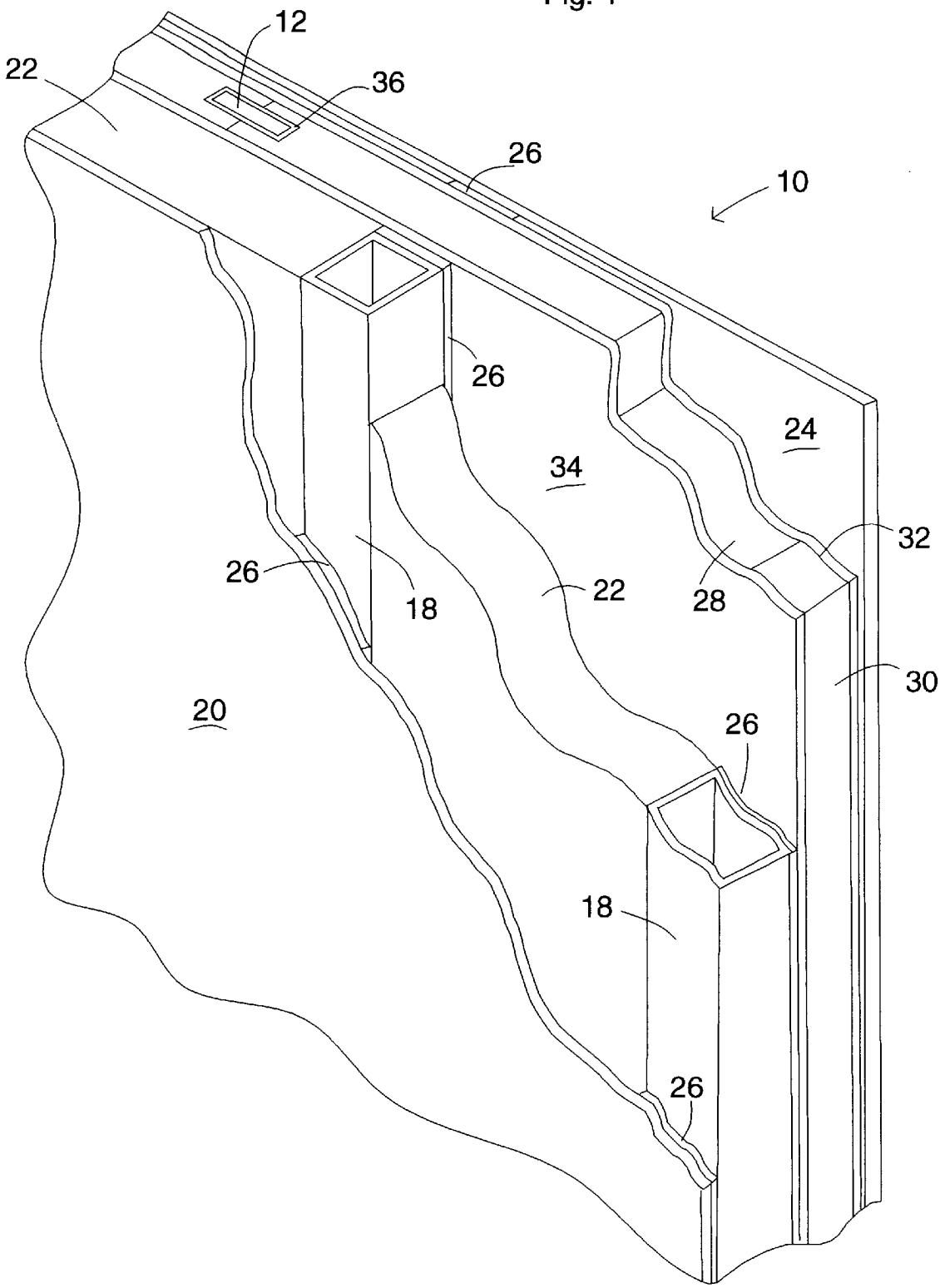
FIG. 1 is a perspective view of a wall section with portions cut away to show interior construction.
Figure 2:
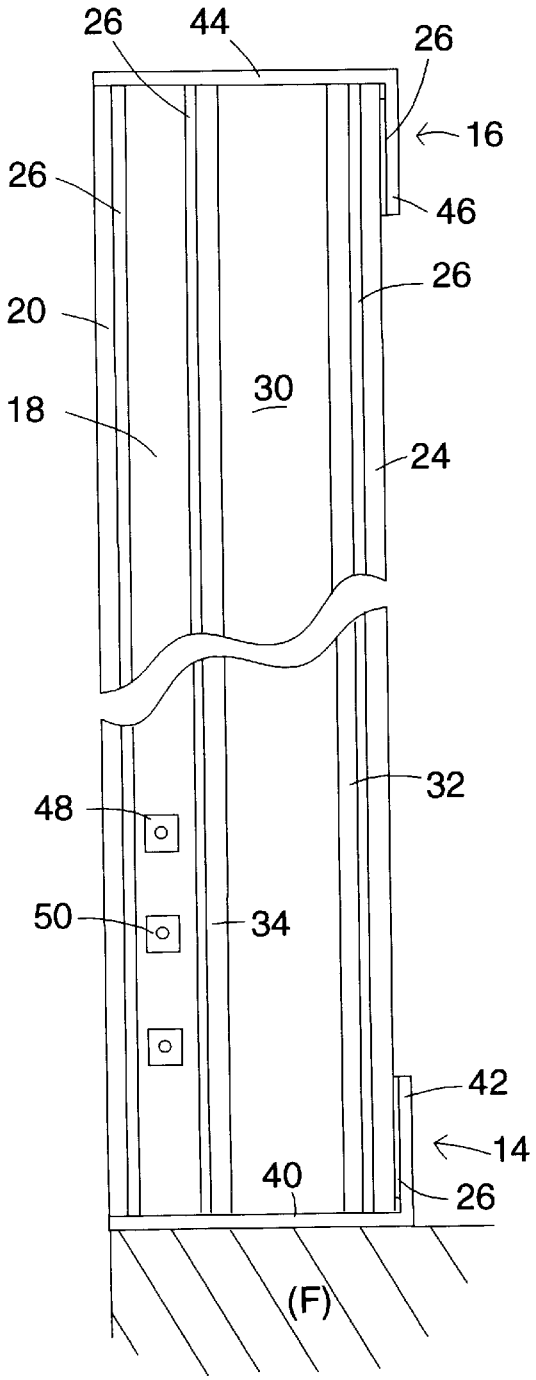
FIG. 2 is an end view of a wall supported on a foundation, with the center part of the wall sectioned out.
Figure 3:
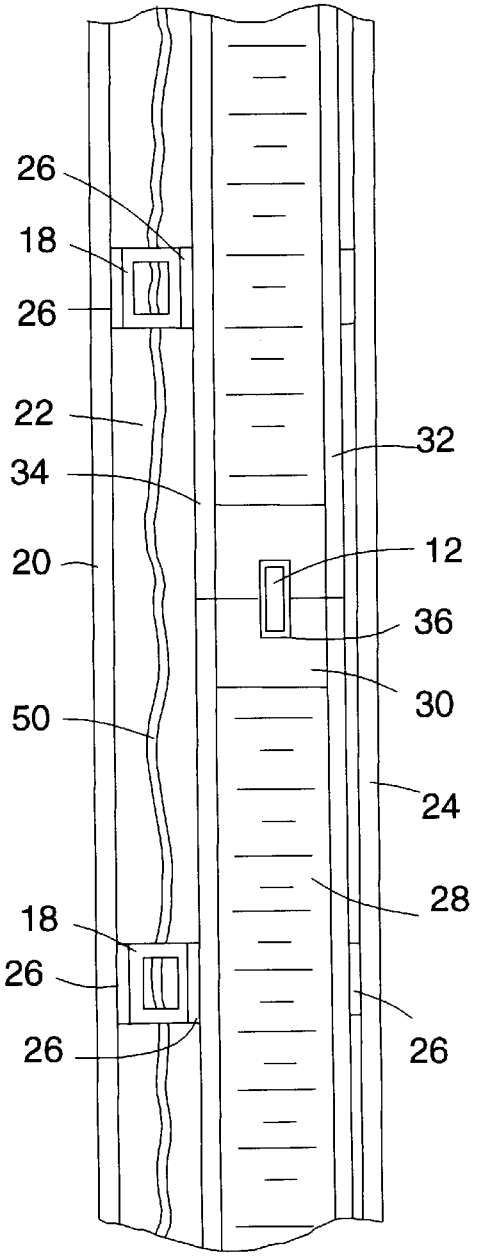
FIG. 3 is a top view of a wall section showing interior construction.
Figure 4:
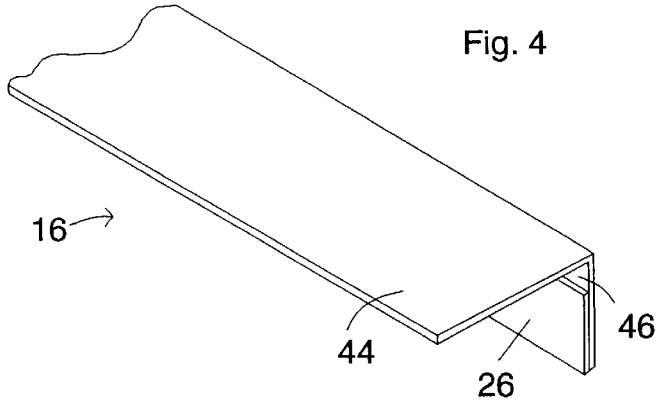
FIG. 4 is a perspective view of a section of a top plate.
Figure 5:
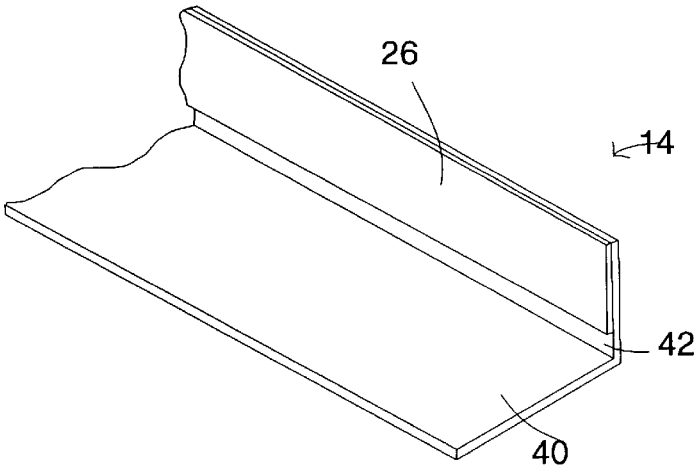
FIG. 5 is a perspective view of a section of a bottom plate.
Figure 6:
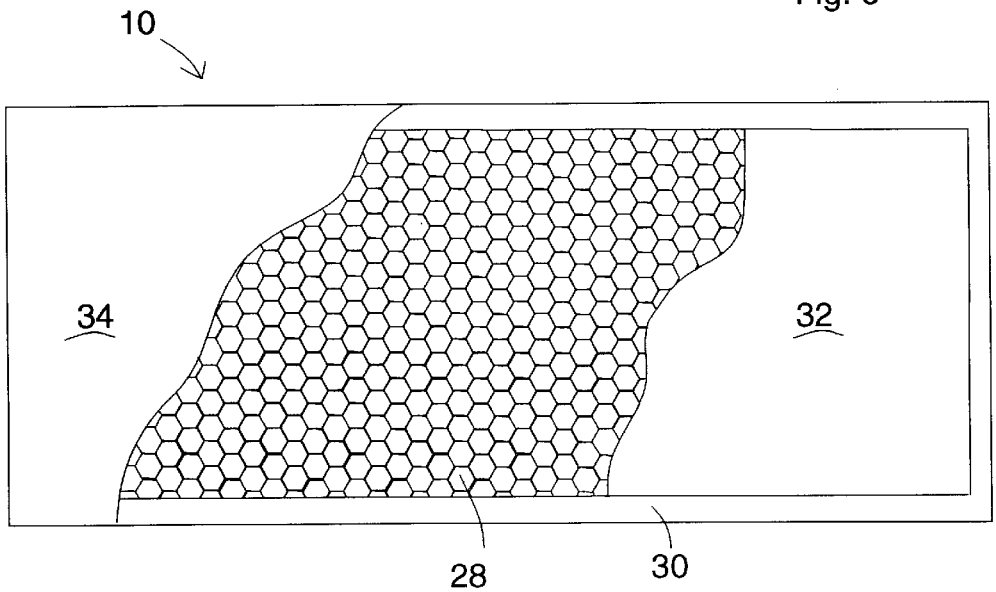
FIG. 6 is a top view of a composite panel with sections cut away to show interior construction.

As best shown in FIGS. 1–3 the wall system of the present invention is comprised of a plurality of preformed, vertical composite wall panels 10 with outer faces toward the building exterior and inner faces toward the building interior. Splines 12 are used to secure the panels in a rigid, edge-to-edge relationship. The lower edges of the wall panels are mounted on a bottom attachment plate 14 to secure the panels to a building floor (F). A top attachment plate 16, which is essential a mirror image of plate 14, is positioned on the upper edges of panels 10 to facilitate attachment of the wall to the building ceiling or roof. A plurality of upright, spaced, studs 18 are attached to the outer faces of panels 10.

The wall system as illustrated also includes exterior surfacing member 20 attached to the outer faces of the studs 18; insulation sections 22 inserted between adjacent studs 18, and between the outer faces of composite panels 10 and the inner surface of the facing member 20; and an interior surfacing member 24 attached to the inner faces of panels 10.

As illustrated in the preferred embodiment, the various wall components are secured to each other with strips of double-sided adhesive tape 26. It will be understood, however, that some of the components can also be secured to each other with adhesives or fasteners.

Each wall panel 10 is comprised of a rectangular honeycomb core 28, a frame or closeout 30 surrounding the periphery of honeycomb core 28, and inner and outer skins 32 and 34, respectively, across opposed faces of honeycomb core 28. Honeycomb core 28 is comprised of adjacent strips of resin impregnated, kraft paper joined at discrete areas and expanded to form a plurality of hexagonal openings. Core 28 has a thickness of 1.5 inches, an interior width of 3 feet and 10 inches, and a length of 7 feet and 10 inches. The inner dimensions of frame 30 surrounding core 28 correspond to the outer periphery of core 28. Frame 30 is formed of four sections of fabricated wood having a thickness of 1 inch. Skins 32 and 34 are formed of fall hard steel having a thickness of 0.30 inch, resulting in a panel having a thickness of 4 inches. The skins are galvanized to reduce rusting, and acid etched to enhance adhesive bonding.

To improve the strength of the wall structure, longitudinal channels are formed between adjacent panels 10, by routing slots into the outer surfaces of the side sections of frame 30. These slots, when the panels are joined, form a channel 36 into which a spline or key 12 formed of cold rolled steel, and having a thickness of one-forth inch, a width of 1 inch and a length equal to the distance between side frame members 18.

The lower edges of panels 10 are mounted on a bottom attachment plate 14 formed of a horizontal plate segment 40 to attach plate 14 to floor (F) and a vertical plate segment 42 to attach plate 14 to the wall. A top attachment plate 16 is used to secure the top of the wall to a roof or ceiling (not shown). Plate 16 is formed of a horizontal plate segment 44 to attach plate 14 to the roof or ceiling and a vertical plate segment 46 to attach plate 16 the wall.

Vertical, parallel studs 18 formed of square tubular steel are secured to the outer face of panels 10 with double-sided adhesive strips 26 at a spacing of 16 inches on center. Studs 18 include pre-formed opening 48 to receive electrical wiring 50.

Outer facing material 20 is secured to the outer faces of studs 18 with strips of double-sided adhesive tape 26. Insulation sections 22 are positioned in the spaces between studs 18. Inner surfacing material 24 is similarly secured to the inner face of panels 10 with tape 26.

When fully assembled, the panels 10 are held in rigid end-to-end alignment. Studs 18 are secured to the exterior of the panels 10 and support exterior surfacing material 20, Cavities formed by studs 18, panels 10 and exterior surfacing material 20, are filled with insulation material 22. Electrical wiring 50 extends through openings 48 in studs 18 on the exterior of non-flammable outer skin 34 of panel 10. As a result, any electrical fire originating from electrical wiring 50 is prevented from reaching the interior of the building by outer skin 34 as well as by inner skin 32.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A wall structure for a manufactured building, said wall having an exterior side and an interior side, comprising:

a) a plurality of adjacent composite panels, each panel having a honeycomb core with opposed faces and a continuous outer periphery, a frame surrounding the periphery of said honeycomb core, and full hard steel exterior and full hard skins secured across the opposed faces of said core; and b) spaced upright studs having openings for carrying electrical wiring secured to the exterior skins of said panels.

2. The wall structure of claim 1, wherein said honeycomb core is formed of resin impregnated paper.

3. The wall structure of claim 1, wherein said studs are spaced, upright tubular steel studs.

4. The wall structure of claim 1, further including splines extending into the frames of adjacent panels.

5. The wall structure of claim 1, wherein said studs are secured to the outer surface of said composite panels with double-sided adhesive tape.

6. The wall structure of claim 1, wherein adjacent wall panels are joined with a flexible adhesive.

7. The wall structure of claim 1, further including insulation material between said studs.

8. The wall structure of claim 1, further including an interior surfacing material attached to said interior skins.

9. The wall structure of claim 1, further including an exterior surfacing material attached to said studs.

10. A wall structure for a manufactured building, said wall having an exterior side and an interior side, comprising:

a) a plurality of adjacent composite panels, each panel having a honeycomb core with opposed faces and a continuous outer periphery, a frame surrounding the periphery of said honeycomb core, and exterior and interior steel skins secured across the opposed faces of said core;

b) spaced, upright studs having openings for carrying electrical wiring secured to the exterior skins of said panels;

c) interior surfacing material attached to said interior skins;

d) exterior surfacing material attached to said studs; upright splines extending into the frames of adjacent panels.

11. The wall structure of claim 10, wherein said studs are spaced, upright tubular steel studs.

12. The wall structure of claim 10, wherein said studs are secured to the outer surface of said composite panels with double-sided adhesive tape.

13. The wall structure of claim 10, further including insulation material between said studs.

14. A wall structure for a manufactured building, said wall having an exterior side and an interior side, comprising:

a) a plurality of adjacent composite panels, each panel having a paper honeycomb core with opposed faces and a continuous outer periphery, a frame surrounding the periphery of said honeycomb core, and exterior and interior steel skins secured across the opposed faces of said core;

b) vertical tubular steel studs having openings for carrying electrical wiring secured to the exterior skins of said panels with double-sided adhesive tape;

c) interior surfacing material attached to said interior skins;

d) exterior surfacing material attached to said studs; and e) insulation material inserted between said studs.

15. The wall structure of claim 14, wherein said panel frame has side sections with outer faces, the faces of adjacent panels having opposed longitudinal slots forming a longitudinal channel, said structure further including splines positioned in said channels.

16. The wall structure of claim 14, further including a bottom attachment plate to attach the wall structure to a building floor.

17. The wall structure of claim 14, further including a top attachment plate to attach the wall structure to the roof or ceiling of a building.

18. The structure of claim 14, wherein said steel skins are formed of full hard steel and have a thickness of from about 0.010 to about 0.10 inch.

* * * * *